US009190258B2

(12) United States Patent
Evans-Nguyen et al.

(10) Patent No.: US 9,190,258 B2
(45) Date of Patent: Nov. 17, 2015

(54) CONTINUOUS OPERATION HIGH SPEED ION TRAP MASS SPECTROMETER

(71) Applicants: The Charles Stark Draper Laboratory, Inc., Cambridge, MA (US); Johns Hopkins University School of Medicine, Baltimore, MD (US); Mini-Mass Counseling, Hyattsville, FL (US)

(72) Inventors: Theresa Evans-Nguyen, Seffner, FL (US); Di Wang, Lutherville-Timonium, MD (US); Friso Van Amerom, Hyattsville, MD (US)

(73) Assignees: The Charles Stark Draper Laboratory, Inc., Cambridge, MA (US); Johns Hopkins University School of Medicine, Baltimore, MD (US); Mini-Mass Counseling, Hyattsville, MD (US)

( * ) Notice: Subject to any disclaimer, the term of this patent is extended or adjusted under 35 U.S.C. 154(b) by 0 days.

(21) Appl. No.: 14/445,551

(22) Filed: Jul. 29, 2014

(65) Prior Publication Data

US 2015/0034820 A1 Feb. 5, 2015

Related U.S. Application Data

(60) Provisional application No. 61/860,100, filed on Jul. 30, 2013.

(51) Int. Cl.
*H01J 49/26* (2006.01)
*H01J 49/02* (2006.01)
(Continued)

(52) U.S. Cl.
CPC ..... *H01J 49/427* (2013.01); *H01J 49/0031* (2013.01); *H01J 49/022* (2013.01); *H01J 49/429* (2013.01); *H01J 49/424* (2013.01)

(58) Field of Classification Search
CPC ..... H01J 49/10; H01J 49/16; H01J 49/422; H01J 49/424; H01J 49/4245; H01J 49/425; H01J 49/4255; H01J 49/423; H01J 49/4235; H01J 49/427; H01J 49/429
USPC ..... 250/281, 282, 283, 286, 287
See application file for complete search history.

(56) References Cited

U.S. PATENT DOCUMENTS 4,882,484 A * 11/1989 Franzen et al. ..... 250/282
5,381,007 A 1/1995 Kelley
(Continued)

FOREIGN PATENT DOCUMENTS

JP 2000-162186 A 6/2000

OTHER PUBLICATIONS

Ding, et al., "A digital ion trap mass spectrometer coupled with atmospheric pressure ion sources", J. of Mass Spectrom. vol. 39: pp. 471-484 (2004).
(Continued)

*Primary Examiner* — Jack Berman
*Assistant Examiner* — David E Smith
(74) *Attorney, Agent, or Firm* — Edward A. Gordon; Foley & Lardner LLP

(57) ABSTRACT

The present disclosure discusses a system and method for continuous operation of an ion trap mass spectrometer. The described system does not introduce ions into the ion trap in distinct trapping phase, rather the described system continuously injects ions into the ion trap while continuously scanning out the ions. The system and method described herein achieves a much higher duty cycle and cycle rate when compared to standard mass spectrometer devices.

20 Claims, 10 Drawing Sheets

(51) Int. Cl.
*H01J 49/42* (2006.01)
*H01J 49/00* (2006.01)

(56) References Cited

U.S. PATENT DOCUMENTS 5,640,011 A * 6/1997 Wells ..... 250/282
5,710,427 A * 1/1998 Schubert et al. ..... 250/282
6,121,610 A * 9/2000 Yoshinari et al. ..... 250/292
2001/0002696 A1 6/2001 Kato
2002/0074492 A1 6/2002 Taniguchi
2007/0069123 A1 * 3/2007 Nagai et al. ..... 250/288
2012/0112056 A1 * 5/2012 Brucker et al. ..... 250/282

OTHER PUBLICATIONS

International Search Report and Written Opinion mailed Dec. 15, 2014 in PCT Application No. PCT/US2014/048598 (10 pages).

* cited by examiner

CONTINUOUS OPERATION HIGH SPEED ION TRAP MASS SPECTROMETER

CROSS-REFERENCE TO RELATED PATENT APPLICATIONS

This application claims priority to U.S. Provisional Patent Application No. 61/860,100, filed on Jul. 30, 2013 and titled "Continuous Operation Ion Trap Mass Spectrometer," which is incorporated herein by reference in its entirety.

GOVERNMENT SUPPORT

This invention was made with government support under HDTRA1-11-1-0012 awarded by the Defense Threat Reduction Agency. The government has certain rights in the invention.

BACKGROUND OF THE DISCLOSURE

Standard mass spectrometers use injection methods for ion trap mass spectrometry that include mutually exclusive loading and scanning ejection time segments. This mode of operation implicitly imparts a duty cycle and acquisition rate limit to ion trap mass analysis because scanning cannot occur while the ion trap is loading.

SUMMARY OF THE DISCLOSURE

According to one aspect of the disclosure, a mass spectrometer includes an ion trap configured to continuously receive ions and an ion source configured to continuously inject the ions into the ion trap. The mass spectrometer also includes an ion detector configured to detect ions when the ions are ejected from the ion trap. The mass spectrometer is controlled by a controller configured to cause a repeated frequency-scanned voltage to be applied to the ion trap during the continuous injection of the ions into the ion trap. The frequency-scanned voltage waveform is scanned from a first frequency to a second frequency, thereby causing the ejection of the ions from the ion trap.

In some implementations, the controller causes the repeated frequency-scanned voltage signal to be applied to a ring electrode of the ion trap. A voltage level of the repeated frequency-scanned voltage signal is between about 200 V and about 1000 V. In some implementations, the first frequency is between about 1.3 MHz and about 700 kHz and the second frequency is between about 350 kHz and about 200 kHz. In some implementations, an end-cap electrode of the ion trap is grounded.

In certain implementations, the controller causes the repeated frequency-scanned voltage signal to be applied to an end-cap electrode of the ion trap. In some implementations, the controller causes a fundamental frequency signal to be applied to a ring electrode of the ion trap. In some implementations, the repeated frequency-scanned voltage signal has an initial frequency between about ½ and about ⅛ of the fundamental frequency. The fundamental frequency is between about 1.3 MHz and about 200 kHz. In some implementations, a magnitude of the voltage of the repeated frequency-scanned voltage signal is an order of magnitude less than a magnitude of the voltage of the fundamental frequency signal.

According to another aspect of the disclosure, a method of generating a mass spectra includes providing a mass spectrometer. The mass spectrometer includes an ion source configured to continuously inject ions into an ion trap. The ion trap is configured to continuously receive ions from the ion source. The mass spectrometer also includes an ion detector and a controller. The controller is configured to apply a repeated frequency-scanned voltage signal to the ion trap. The method also includes injecting, in a continuous fashion, ions into the ion trap from the ion source. The method further includes scanning the repeated frequency-scanned voltage signal applied to the ion trap from a first frequency to a second frequency during the continuous injection of ions into the ion trap, thereby causing the ejection of the ions from the ion trap. Ions ejected from the ion trap are detected by the ion detector.

In some implementations, the method includes applying the repeated frequency-scanned voltage signal to a ring electrode of the ion trap. In some implementations, the method includes scanning the repeated frequency-scanned voltage signal from the first frequency to the second frequency according to a logarithmic progression.

In some implementations, the first frequency is between about 1.3 MHz and about 700 kHz and the second frequency is between about 350 kHz and about 200 kHz. A magnitude of the voltage of the repeated frequency-scanned voltage signal is between about 200 V and about 1000 V.

In some implementations, the method includes applying the repeated frequency-scanned voltage signal to an end-cap electrode of the ion trap and applying a fundamental frequency voltage signal to a ring electrode of the ion trap at a constant frequency. In some implementations, the repeated frequency-scanned voltage signal has an initial frequency between about ½ and about ⅛ of the fundamental frequency. In some implementations, a voltage of the repeated frequency-scanned voltage signal is an order of magnitude less than a magnitude of the voltage of the fundamental frequency signal.

BRIEF DESCRIPTION OF THE DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The system and method may be better understood from the following illustrative description with reference to the following drawings in which.

DETAILED DESCRIPTION

The various concepts introduced above and discussed in greater detail below may be implemented in any of numerous ways, as the described concepts are not limited to any particular manner of implementation. Examples of specific implementations and applications are provided primarily for illustrative purposes.

Figure 1:
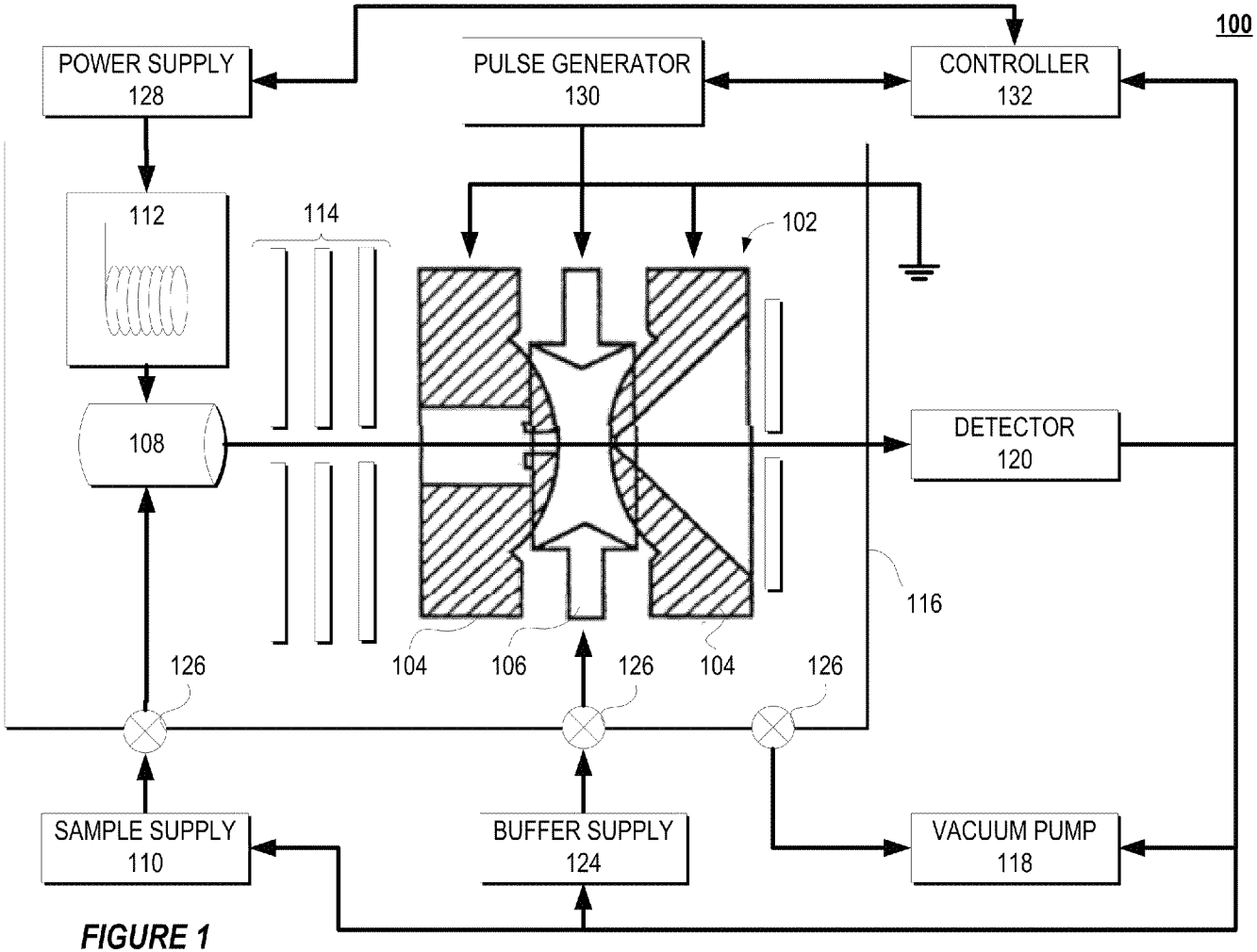
FIG. 1 illustrates a block diagram of an example system for continuous operation mass spectrometry.

FIG. 1 illustrates a block diagram of an example system 100 for continuous operation mass spectrometry. The system 100 includes an ion trap 102. The ion trap 102 includes two end-cap electrodes 104 and a ring electrode 106. Ions are injected into the ion trap 102 from an ion source housing 108. A sample is provided to the ion source housing 108 from a sample supply 110. The sample is ionized by a filament assembly 112. Injection of ions into the ion trap 102 is gated by a lens stack 114. The ion trap 102, lens stack 114, ion source housing 108, and filament assembly 112 are housed within a vacuum chamber 116. The vacuum within the vacuum chamber 116 is maintained by a vacuum pump 118. When ejected from the ion trap 102, the ions are passed to a detector 120, which sends a signal to a controller 132. A buffer is provided to the ion trap 102 from the buffer supply 124. The flow gas (or sample) into and out of the vacuum chamber 116 is controlled through valves 126. The filament assembly 112 is powered by a power supply 128. The ion trap 102 is driven by a pulse generator 130. The various components of the system 100 are controlled by the controller 132.

The system 100 includes a vacuum chamber 116, which houses the ion trap 102. The vacuum pump 118, controlled by the controller 132, controls the pressure within the vacuum chamber 116. In some implementations, the vacuum 118 is configured to maintain a pressure of between about $1\times10^{-3}$ Torr and about $2\times10^{-5}$ Torr. In some implementations, the vacuum pump is a turbomolecular pump, an oil diffusion pump, or a cryopump. In some implementations, the vacuum pump is backed by a mechanical pump.

Within the vacuum chamber 116, the system 100 includes a filament assembly 112. The filament assembly 112 is configured to receive current from the power supply 128. The current passing through a filament within the filament assembly 112 causes the filament to heat to a predetermined temperature. The predetermined temperature causes the sample within the ion source housing 108 to ionize. The amount of current passed to the filament assembly 112 is proportional to the temperature achieved by the filament of the filament assembly 112. In some implementations, the current passed to the filament assembly 112 is between about 0.5 A and about 1.5 A, between about 0.75 A and about 1.25 A, or between about 1 A and about 1.2 A. In some implementations, the controller 132 selects an appropriate level of current to pass to the filament assembly 112 based on the level of ions needed to fill the ion trap. In other implementations, a technician may manually input a specific current level that is to be provided to the filament assembly 112 by the power supply.

The system 100 also includes the sample supply 110, which supplies the sample to the ion source housing 108 and filament assembly 112 for ionization. The sample supply 110 may include a pump that injects the sample into the ion source housing 108. In some implementations, the sample supply 110 is configured to flow the sample into the ion source housing 108 at a predetermined rate. In other implementations, the sample supply 110 is configured to maintain a predetermined partial pressure of the sample in the ion source housing 108. In another example, the sample may be leaked into the ion source housing 108 from the sample supply 110 through a valve 126 (e.g., a precision leak valve 126) to a partial pressure between about $1\times10^{-5}$ Torr to about $5\times10^{-5}$ Torr. In some implementations, the flow rate (or desired partial pressure) of the sample into the ion source housing 108 is dependent on the composition of the sample. In some implementations, the flow of the sample into the ion source housing 108 is controlled automatically by the controller 132.

The system 100 also includes the lens stack 114 within the vacuum chamber 116. In some implementations, the lens stack 114 includes a plurality of einzel lenses. The controller 132 can control the flow of ions into the ion trap 102 by charging the lens of the lens stack 114. The charge of the lens focus or blocks the flow of ions through the lens stack 114. In some implementations, a DC potential is applied to the second lens in the lens stack 114 to "open" the lens stack 114. Accordingly, the lens stack 114 can gate the entrance of ions into the ion trap 102. During the continuous injection mode of the system 100 described herein, the DC potential is continuously applied to the lens stack 114 enabling a constant influx of ions into the ion trap 102 from the ion source housing 108.

The system 100 also includes the ion trap 102. In some implementations, the ion trap 102 is a 3D quadrupole ion trap 102 electrode assembly. In other implementations, the ion trap 102 is a linear ion trap 102. In some implementations, the ion trap 102 has a stretched geometry ($r_0$=0.707 cm, $z_0$=0.783 cm), while in other implementations the ion trap 102 is configured in a non-stretched geometry. In some implementations, the voltages and frequencies used with the ion trap are dependent on the geometry of the ion trap. FIG. 1 illustrates a cross sectional view of the ion trap 102 and illustrates that the ion trap 102 includes the two end-caps 104 and the central ring electrode 106. In some implementations, the ring electrode 106 is a toroidal ring electrode. The ion trap 102 is able to trap ions according to the Mathieu stability parameters. Ion trapping within the ion trap 102 is governed by the equation:

$$m = \frac{8\ \text{eV}}{q_z(2z^2 + r^2)\Omega^2}$$

where m is the mass of the ion, e is the charge, V is the radio frequency (rf) fundamental voltage, r and z are the dimensions of the ion trap hyperbolic surfaces, Ω is the rf fundamental frequency, and $q_z$ is the parameter at the boundary edge of the Methieu stability conditions. As an overview, and as described in greater detail below, a fundamental (or a supplemental) rf waveform is applied to the ring (or end-cap) electrodes in a sweeping fashion (e.g., the applied frequency logarithmically sweeps from a first frequency to a second frequency). As the frequency is swept, the trapping efficiency of the ion trap 102 changes, enabling the selective release of ions from the trap based on the ion's mass-charge ratio.

The system 100 also includes a pulse generator 130 that powers and applies the selected frequency-scanned waveform to the ion trap 102. The pulse generator is electrically coupled with the two end-caps 104 and the ring electrode 106. In a first operating mode, the two end-cap electrodes 104 are grounded and a selected frequency-scanned waveform and voltage is applied to the ring electrode. In a second operating mode (called resonant ejection), a constant frequency and fixed voltage is applied to the ring electrode 106 and a sweeping frequency-scanned waveform is applied to the two end-cap electrodes 104. In some implementations, the waveformed applied to the ring electrode 106 is referred to as the fundamental waveform and the waveform applied to the end-cap electrodes 104 is referred to as the supplemental waveform. In some implementations, the voltage applied to the two end-cap electrodes 104 during resonant ejection is much less than the voltage applied to the ring electrode 106 during resonant ejection. For example, the voltage level applied to the two end-cap electrodes 104 may be about an order of magnitude less than the voltage level applied to the ring electrode 106.

In some implementations, the pulse generator 130 includes a function generator that generates a precise digital waveform and a high-voltage power supply to supply the voltage required to power the ion trap 102. For example, the function generator may be a Stanford Research DS345 multifunction generator or similar waveform generator capable of generated square waves between about 100 kHz and about 1.5 MHz. An example high-voltage power supply is the Glassman EK series high-voltage power supply or another power supply capable of generating a voltage of between about 200 V and about 1200 V. In other implementations, the pulse generator 130 can include custom circuitry to power the ion trap 102. The pulse generator 130 can include high voltage switches constructed from MOSFETs that switch between high and lower DC power levels to create the desired waveform. The pulse generator 130 is configured to generate a high-voltage signal between about ±100 V and about ±1000 V, between about ±200 V and about ±800 V, or between about ±400 V and about ±600 V. In some implementations, the pulse generator 130 is configured to generate a signal with a frequency between about 100 kHz and about 1.5 MHz., between about 200 kHz and about 1 MHz, or between about 250 kHz and about 950 kHz.

In some implementations, the system 100 is configured to operate in a standard mode or a resonant ejection mode. In the standard mode, the pulse generator 130 applies the digital waveform to the ring electrode 106 and grounds the end-cap electrodes 104. The frequency of the digital waveform is then swept between a first frequency and a second frequency. In some implementations, the first frequency is referred to as the start frequency and the second frequency is referred to as the stop frequency. In some implementations when the system 100 is configured in the resonant ejection mode, a supplemental waveform is applied to the two end-cap electrodes 104 while a fundamental waveform with a fixed DC voltage level and constant frequency is applied to the ring electrode 106. In some implementations, the frequency of the supplemental waveform is between about ½ and about ⅛ of the fundamental waveform frequency initially applied to the ring electrode 106. In some implementations, the supplemental waveform is "low-power" when compared to the fundamental waveform. In one resonant ejection mode example, a signal with a 600 $V_{peak\text{-}peak}$ voltage may be applied to the ring electrode with a constant fundamental frequency of 1.16 MHz. A 5 $V_{peak\text{-}peak}$ signal may then be applied to the two end-cap electrodes 104, which is logarithmically swept from 350 kHz to 10 kHz. In some implementations, the voltage level of the supplemental waveform is between about 5 $V_{peak\text{-}peak}$ and about 10 $V_{peak\text{-}peak}$.

The system 100 also includes the detector 120, which detects ions as they are ejected from the ion trap 102. In some implementations, the detector 120 is a faraday cup, electron multiplier, or a pulse-counting detector. In general, when an ion (or other energetic particle) comes into contact with the detecting surface (a metal or semiconductor layer) in the detector 120, electrons are released from the detecting surface. The electrical signal generated by the released electrons is amplified and passed to the controller 132. In some implementations, the detector 120 includes high-speed amplifier circuitry and has a scan speed between about 10 kTh/s and about 1.2 MTh/s.

Figure 2:
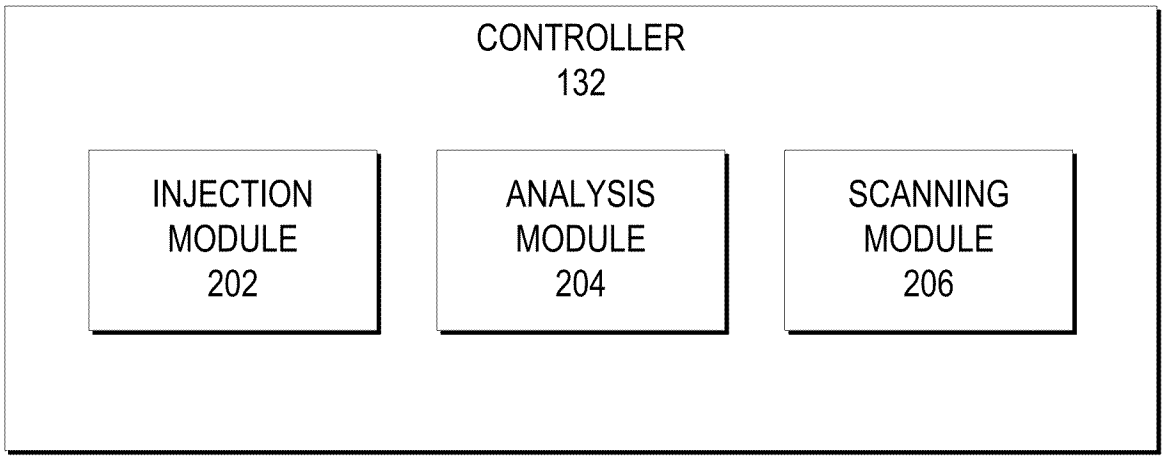
FIG. 2 illustrates a block diagram of the example components of the controller for use with the system illustrated in FIG. 1.

The system 100 also includes a controller 132 that controls the function and operation of the various components of system 100. FIG. 2 illustrates a block diagram of the example components of the controller 132. In general, the controller 132 controls the continuous inject of ions into the ion trap 102. The controller 132 also controls frequency sweeps applied to the ion trap 102, including the range of the frequency sweep and the cycle length of each frequency sweep. In some implementations, the controller 132 controls the frequency sweeps and cycle lengths such that the mass spectrometer described herein has a scanning speed between about 10 Hz and about 1000 Hz. Referring to FIG. 2, the controller 132 includes an injection module 202, an analysis module 204, and a scanning module 206. In some implementations, the controller 132 includes memory, such as a hard-drive, integrated circuit memory, or other computer readable medium, for the storage of mass spectra data and instructions to be executed by the modules of the controller 132. In some implementations, one or more of the modules or operations performed by the controller 132 are implemented as software executed by a general purpose computer, special purpose logic circuitry, or a combination thereof. For example, the controller 132 can include an FPGA (field programmable gate array) or an ASIC that performs the methods described herein. In some implementations, the controller 132 includes one or more user interface elements that enable a user to control the system 100 described herein. For example, the controller 132 can include a plurality of buttons and knobs that enable the user to adjust the frequencies and voltages applied to the ion trap 102. In some implementations, the controller 132 may include (or be coupled to a monitor) onto which graphical user interface elements are displayed. Through the graphical user interface the user can interact with the system 100 to adjust the frequencies of the signals, voltage levels of the signals, and other parameters of the system 100.

The injection module 202 of the controller 132 controls the injection of the sample into the ion source housing 108 and the injection of the ions into the ion trap 102. In some implementations, the controller 132 is electrically coupled with the power supply 128, the valves 126, the lens stack 114, and the sample supply 110 (or pump thereof) to control the injection of ions into the ion trap 102. The system 100 described herein continuously injects ions into the ion trap. In a standard mass spectrometer, ions are introduced into an ion trap in distinct trapping phase. The trapped ions are then scanned out in a distinct ejection phase after a cooling period. The injection and ejection phase of a standard mass spectrometer causes the standard mass spectrometer to have a duty cycle significantly less than 100%. The system 100 described herein continuously introduces and simultaneously scans out ions, making the system 100 capable of achieving a near 100% duty cycle.

The injection module 202 controls the amount of ions that are injected into the ion trap 102 by controlling the amount of sample that is introduced to the ion source housing 108 and by controlling the amount of current flowed through the filament assembly 112. In some implementations, the injection module 202 dynamically controls the injection of ions into the ion trap 102. For example, the injection module 202 adjusts the parameters of the power supply 128 and flow rate from the sample supply 110 to control the ionization of the sample and ultimately the amount of ions provided to the ion trap 102. For example, by increasing the current flow into the filament assembly 112, the relative rate of ion production increases. In some implementations, the current is adjusted to prevent the ion trap 102 from overfilling. In some implementations, the injection module 202 also includes an input into the scanning module 206 and controls the trapping of the ions into the ion trap 102 by adjusting the fundamental or supplemental scanning frequency. In another example, the injection module 202 adjusts the scanning time or cycle time of the frequency sweeps. For example, the injection module 202 may cause the scanning module 206 to hold the frequency applied to the ion trap 102 constant for a longer period of time prior to starting a sweep such that the ion trap 102 has a relatively larger number of ions stored within the trap. Modulation of the frequencies and timing of each scan enables on the fly control of successive scan speeds based on the detector signal.

The controller 132 also includes the analysis module 204. In some implementations, the analysis module 204 receives an output signal from the detector 120. In some implementations, the analysis module 204 digitizes the signal from the detector 120 such that the signal may be digitally stored and analyzed. In some implementations, the analysis module 204 receives a digital signal from an external analog to digital converter that is coupled to the detector 120. For example, the analysis module 204 may be electrically coupled to a digital oscilloscope or data acquisition board that acquires the signal from the detector 120, digitizes the signal, and transmits a digital signal to the analysis module 204. In some implementations, the analysis module 204 can perform analysis functions on the received data. For example, the analysis module 204 may automatically identify peaks in the mass spectra. In another example, the analysis module 204 may average a plurality of scans to remove noise from the recorded signal. For example, the mass spectrometer described herein may perform 10 scans per second. Each of the scans may include random noise. The analysis module 204 may average the scans performed over each second together to generate an averaged spectra for the sample. By averaging the scans together the random noise is averaged out of the signal, making it easier to distinguish the true peaks in the spectra. In some implementations, the analysis module 204 detects high intensity peaks, which are then isolated for tandem mass spectrometry.

The controller 132 also includes a scanning module 206. The scanning module 206 interfaces with the pulse generator 130 to set and control the mode of operation of the ion trap 102, frequencies swept, and the length of each scanning cycle. First, a user may use the scanning module 206 to set the mode of operation of the ion trap 102. For example, the user may select between a standard mode where the fundamental frequency is applied to the ring electrode 106 and the end-cap electrodes 104 are grounded and a resonant ejection mode where a fixed fundamental frequency waveform is applied to the ring electrode 106 and a frequency swept supplemental waveform is applied to the two end-cap electrodes 104. In each of these modes, ions are continuously injected into the ion trap 102. The scanning module 206 also controls the cycle time and scan time. The scan time denotes the duration of each frequency sweep (e.g., the amount of time it takes to generate one scan). The cycle time denotes the time (as marked by their starting points) between two adjacent scans. For example, on a cycle that scans from 950 kHz to 200 kHz, the time it takes to logarithmically scan from 950 kHz to 200 kHz is the scan time. Once the system sweeps down to 200 kHz, the frequency is immediately reset to 950 kHz for the remainder of the cycle time. The time from when the system started the first scan to the time the frequency is reset to 950 kHz is the cycle time.

Figure 3:
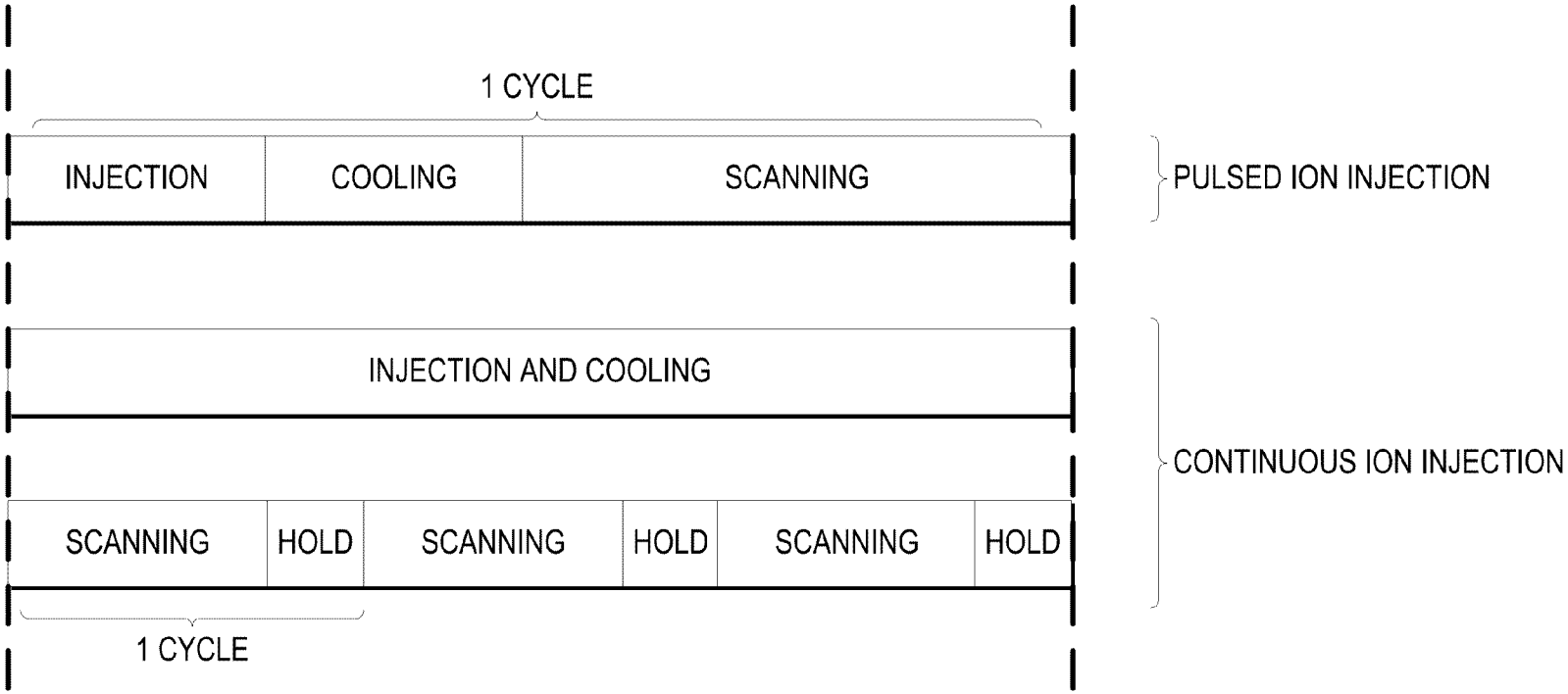
FIG. 3 illustrates a block diagram illustrating the time scheme of continuous operation mass spectrometry, such as that performed by the system illustrated in FIG. 1.

FIG. 3 illustrates a block diagram illustrating the time scheme of a mass spectrometer described herein compared to a standard mass spectrometer. The top row of the scheme illustrates the timing of a standard mass spectrometer. First, ions are injected into the ion trap by gating an ion lens to enable ions to enter the ion trap. The lens is then closed, and, during the second phase, the ions are cooled. After the cooling phase, a scan is performed. A new cycle would begin with the injection of another burst of ions. In contrast, as indicated by the second row, in a continuous ion injection mode of the present disclosure, ions are continuously injected into the ion trap. The third row illustrates that while the ions are continuously injected into the ion trap and cooled, scans are repeatedly performed. As illustrated, the cycle time for the pulsed ion injection mode is much longer than the cycle time for the continuous ion injection mode. The third row of FIG. 3 illustrates that in the span of one pulsed ion cycle, the continuous injection system is able to perform three scans. FIG. 3 compares just one possible cycle rate of the system described herein. In some implementations, the system described herein can have a cycle frequency of greater than 1000 Hz, and can perform ten or more cycles per cycle of the standard mass spectrometer. Between each scan the continuous injection system resets the frequency and may hold the frequency constant for a predetermined about of time while the ion trap refills. Because the continuous ion injection mode does not have distinct injecting and cooling phases, the cycle time of the continuous ion injection mode can be much lower compared to the cycle time of a pulsed ion injection system. For example, the continuous ion injection mode can have a cycle rate of about 1 ms (giving a cycle frequency of about 1000 Hz).

Figure 4:
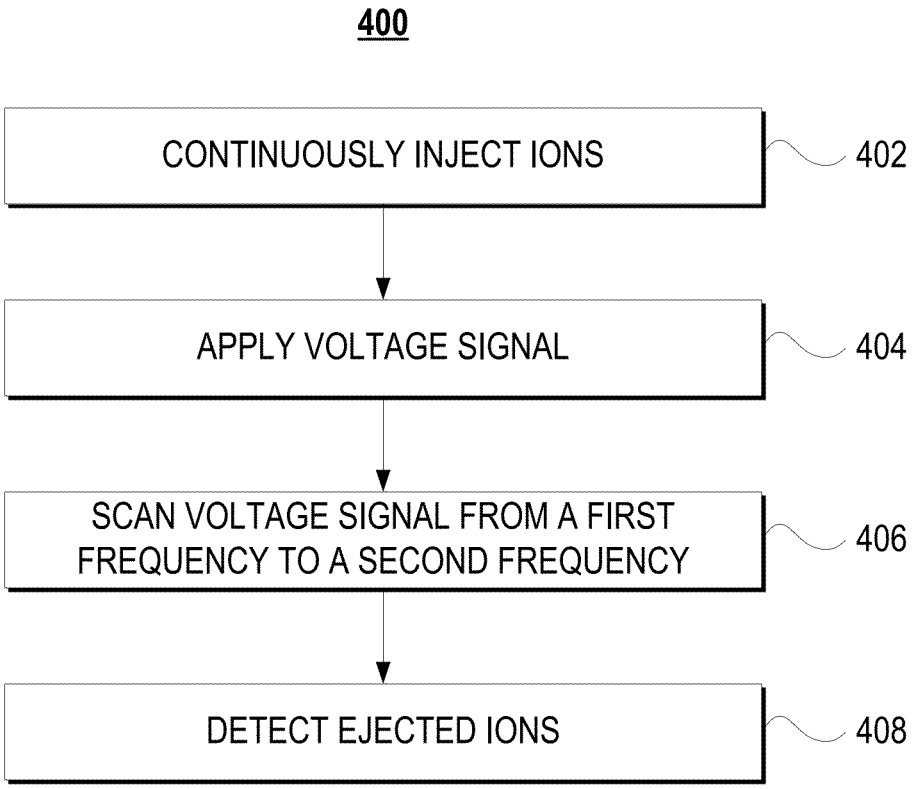
FIG. 4 illustrates a block diagram of an example method for continuous ion injection using the system illustrated in FIG. 1.

FIG. 4 illustrates a block diagram of an example method 400 for continuous ion injection. The method 400 includes continuously injecting ions into an ion trap (step 402). A voltage signal is applied to the ion trap (step 404). The voltage signal is swept from a first frequency to a second frequency (step 406). The ions ejected from the ion trap are then detected (step 408).

As set forth above, the method 400 includes the continuous injection of ions into the ion trap (step 402). As described above, at the start of an experiment a voltage is applied to the lens stack, "opening" the lens stack and enabling the passage of ions into the ion trap. Current is provided to a filament assembly from a power supply, generating a continuous stream of ions into the ion trap. In some implementations, the current provided to the filament assembly or the amount of sample provided to the ion source housing is varied by a controller to control the amount of ions that are continuously injected into the ion trap.

The method 400 includes applying a voltage signal to the ion trap (step 404). In the continuous ion injection mode without resonant ejection, the end-cap electrodes are grounded, and the voltage signal (also referred to as a fundamental waveform) is applied to the ring electrode. The fundamental waveform is applied with a predetermined or configurable voltage level. In some implementations, the fundamental waveform voltage level is between about ±200 V and about ±1000 V. In some implementations, the fundamental waveform signal has a frequency between about 250 kHz and 1.5 MHz. In some implementations, the fundamental waveform signal is a square wave generated by switching between high and low DC levels. In some implementations, the frequency of the fundamental waveform initially applied to the ring electrode is the highest frequency that is scanned in step 406 of method 400. For example, if the frequency to be scanned is from 1 MHz to 250 kHz, the initially applied frequency of the fundamental waveform is 1 MHz.

Figure 5:
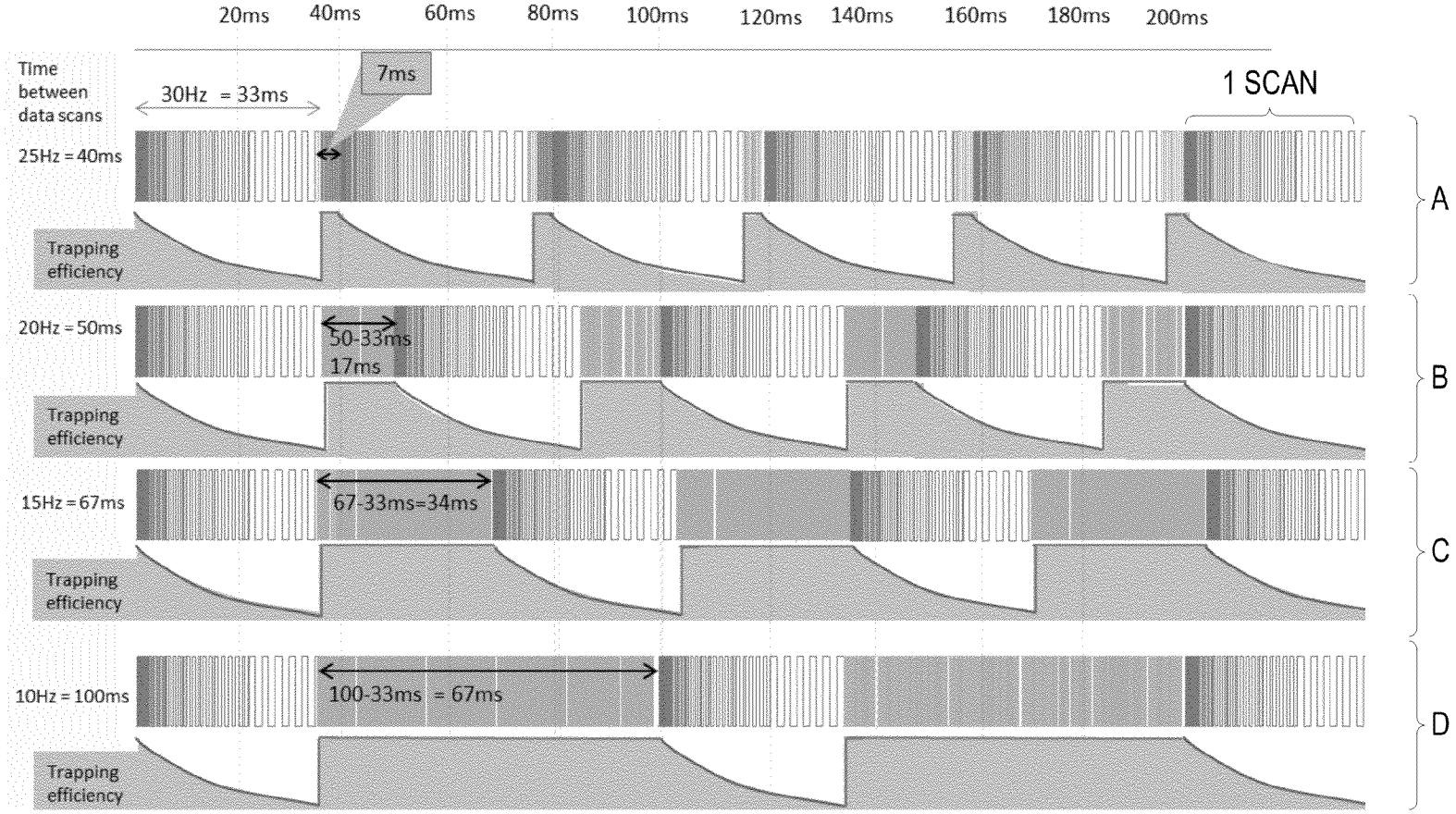
FIG. 5 illustrates the effect of a frequency sweep on the trapping efficiency of the system illustrated in FIG. 1.

Next, and also referring to FIG. 5, the frequency of the voltage signal is swept from a first frequency to a second frequency (step 406). FIG. 5 illustrates the effect of the frequency sweep on trapping efficiency. As ions are continuously injected into the ion trap, the frequency applied to the ring electrode is swept from the first frequency to the second frequency. For example, the frequency of the voltage signal may be swept from about 900 kHz to about 200 kHz with a 400 $V_{peak\text{-}peak}$, followed by a return to the initial, first frequency (900 kHz in this example). FIG. 5 illustrates five different example cycle times. In each of the examples, the scanning time is about 33 ms, but in each iteration the cycle time is extended by holding the initial frequency constant. For example, the time the fundamental frequency is held constant ranges from about 7 ms in Example A (where the scan rate is 25 Hz or about every 40 ms) to about 67 ms in Example D (where the scan rate is about 10 Hz or about every 100 ms). As illustrated, when the fundamental frequency is held high (at the first frequency) the ion trap has a relatively high trapping efficiency. As the fundamental frequency is swept down toward the second frequency, the trapping efficiency of the ion trap decreases. As the trapping efficiency decreases, progressively lighter ions are ejected toward the detector from the ion trap. When the sweep reaches the second frequency, the applied fundamental frequency returns to the first frequency. In some implementations, the longer the fundamental frequency is held at the first frequency, the more ions the ion trap can capture for each scan. In some implementations, the sweep from the first frequency to the second frequency occurs in a logarithmic progression.

The ejected ions are detected by the detector (step 408). As the ions are ejected from the ion trap, they come into contact with the detector. The contact of the ions with the detector elicits the release of electrons from the detector and causes the generation of an electrical signal. The electrical signal is amplified and supplied to the controller for storage, display, and analysis.

Figure 6:
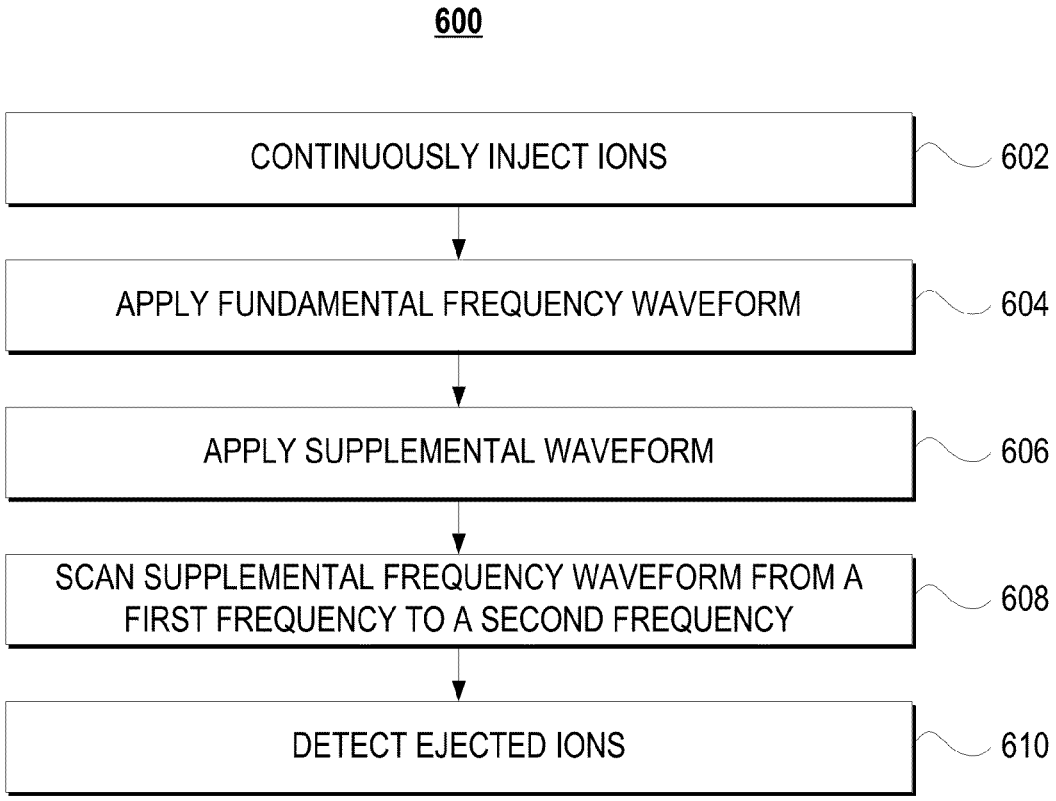
FIG. 6 illustrates a block diagram of an example method for continuous ion injection with resonant ejection using the system illustrated in FIG. 1.

FIG. 6 illustrates a block diagram of an example method 600 for continuous ion injection with resonant ejection. The method 600 includes continuously injecting ions into an ion trap (step 602). A fundamental waveform is applied to the ion trap (step 604). A supplemental waveform is applied to the end-cap electrodes (step 606). The frequency of the supplemental waveform is swept from a first frequency to a second frequency (step 608). The ions ejected from the ion trap are then detected (step 610).

As set forth above, the method 600 includes the continuous injection of ions into the ion trap (step 602). As described above, at the start of an experiment a voltage is applied to the lens stack 114, "opening" the lens stack and enabling the passage of ions. Current is provided to a filament assembly from a power supply, generating a continuous stream of ions into the ion trap. In some implementations, the current provided to the filament assembly or the amount of sample provided to the ion source housing is varied by a controller to control the amount of ions that are continuously injected into the ion trap.

The method 600 includes applying a fundamental waveform to the ion trap (step 604). In the continuous ion injection mode with resonant ejection, a fundamental waveform with a constant frequency is applied to the ring electrode of the ion trap. In some implementations, the fundamental waveform is a square wave generated by switching between high and low DC levels. The fundamental waveform frequency is applied with a predetermined voltage. In some implementations, the predetermined voltage is between about ±200 V and about ±1000 V. In some implementations, the fundamental waveform frequency is between about 250 kHz and 1.5 MHz.

A supplemental waveform is applied to the end-cap electrodes of the ion trap (step 606). In some implementations, the magnitude of the voltage of the supplemental waveform is much lower than that of the voltage of the fundamental waveform. For example, the magnitude of the voltage of the supplemental waveform may be an order of magnitude or more less than the voltage of the fundamental waveform. In some implementations, the magnitude of the supplemental waveform is between about 5 V and about 10 V. The initial frequency of the supplemental waveform is between about ½ and ⅛ of the frequency of the fundamental waveform. For example, the initial frequency of the supplemental waveform is between about 10 kHz and about 500 kHz.

Figure 7:
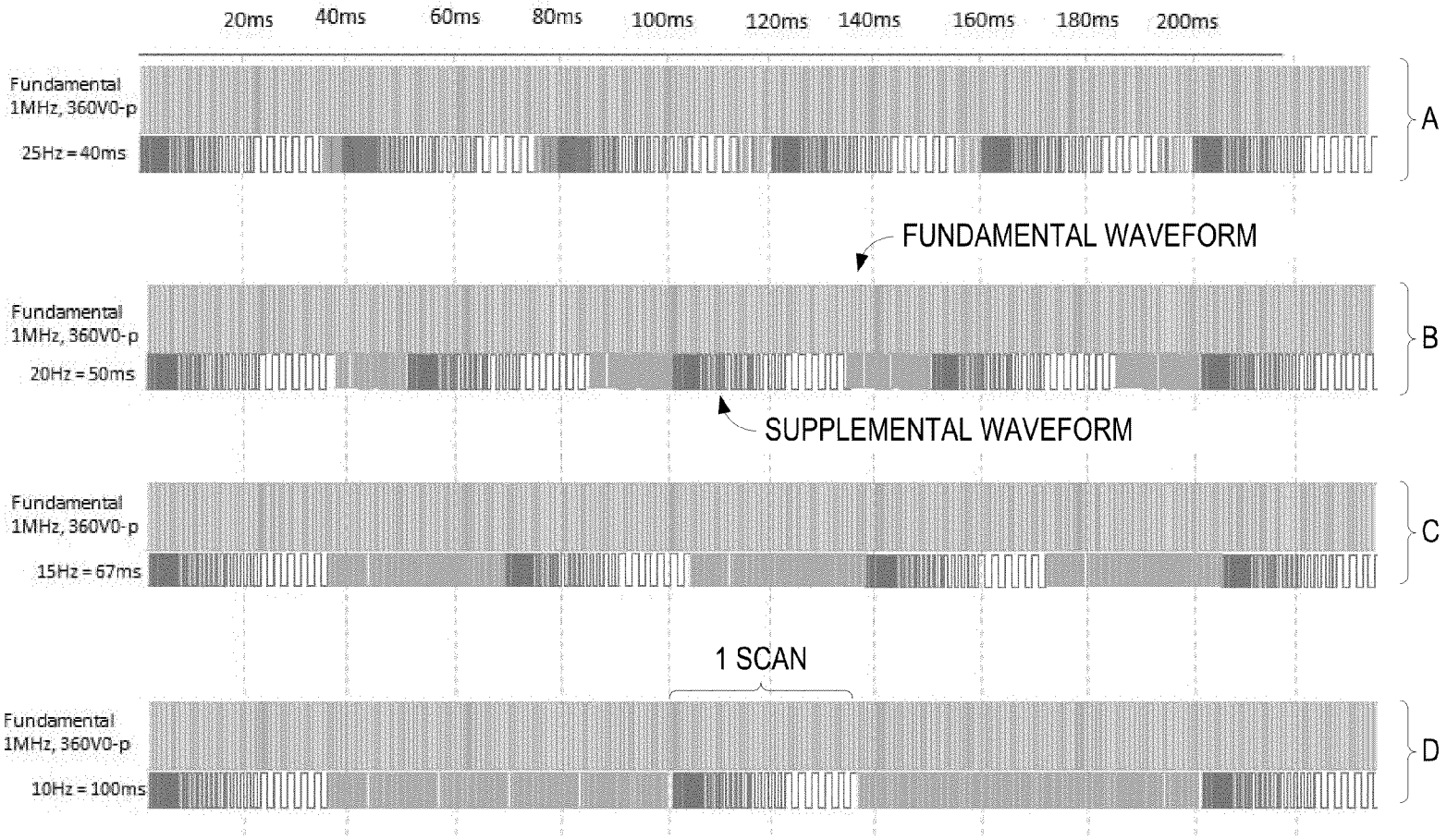
FIG. 7 illustrates example supplemental waveforms with different cycle times that are applied to the end-cap electrodes during the method illustrated in FIG. 6.

Next, and also referring to FIG. 7, the frequency of the supplemental waveform is swept from a first frequency to a second frequency (step 608). In some implementations, the frequency of the supplemental waveform is swept from about 500 kHz to about 10 kHz, from about 400 kHz to about 10 kHz, from about 300 kHz to about 10 kHz, or from about 200 kHz to about 10 kHz. FIG. 7 illustrates supplemental waveforms with different cycle times that are applied to the end-cap electrodes plotted with the fundamental waveforms applied to the ring electrode. In each example, the fundamental waveform is held constant at 1 MHz, 360 $V_{0P}$. In Example A of FIG. 7, the cycle time of the supplemental waveform is 40 ms (25 Hz). In Example B of FIG. 7, the cycle time of the supplemental waveform is 50 ms (20 Hz). In Example C of FIG. 7, the cycle time of the supplemental waveform is 67 ms (15 Hz). In Example D of FIG. 7, the cycle time of the supplemental waveform is 100 ms (10 Hz). In some implementations, the cycle time is between about 10 ms (1000 Hz) and about 1000 ms (10 Hz). As the supplemental waveform frequency is swept down from the first frequency toward the second frequency, ions are ejected from the ion trap. When the sweep reaches the second frequency, the applied supplemental frequency returns to the first supplemental frequency. When configured in the resonant ejection mode, ions are continuously trapped and ejected from the ion trap.

Referring again to FIG. 6, the ejected ions are detected (step 610). As the ions are ejected from the ion trap, they come into contact with the detector. The contact of the ions with the detector elicits the release of electrons from the detector and causes the generation of an electrical signal. The electrical signal is amplified and supplied to the controller for storage, display, and analysis.

The invention may be embodied in other specific forms without departing from the spirit or essential characteristics thereof. The forgoing implementations are therefore to be considered in all respects illustrative, rather than limiting of the invention.

Experimental Results

Figure 8:
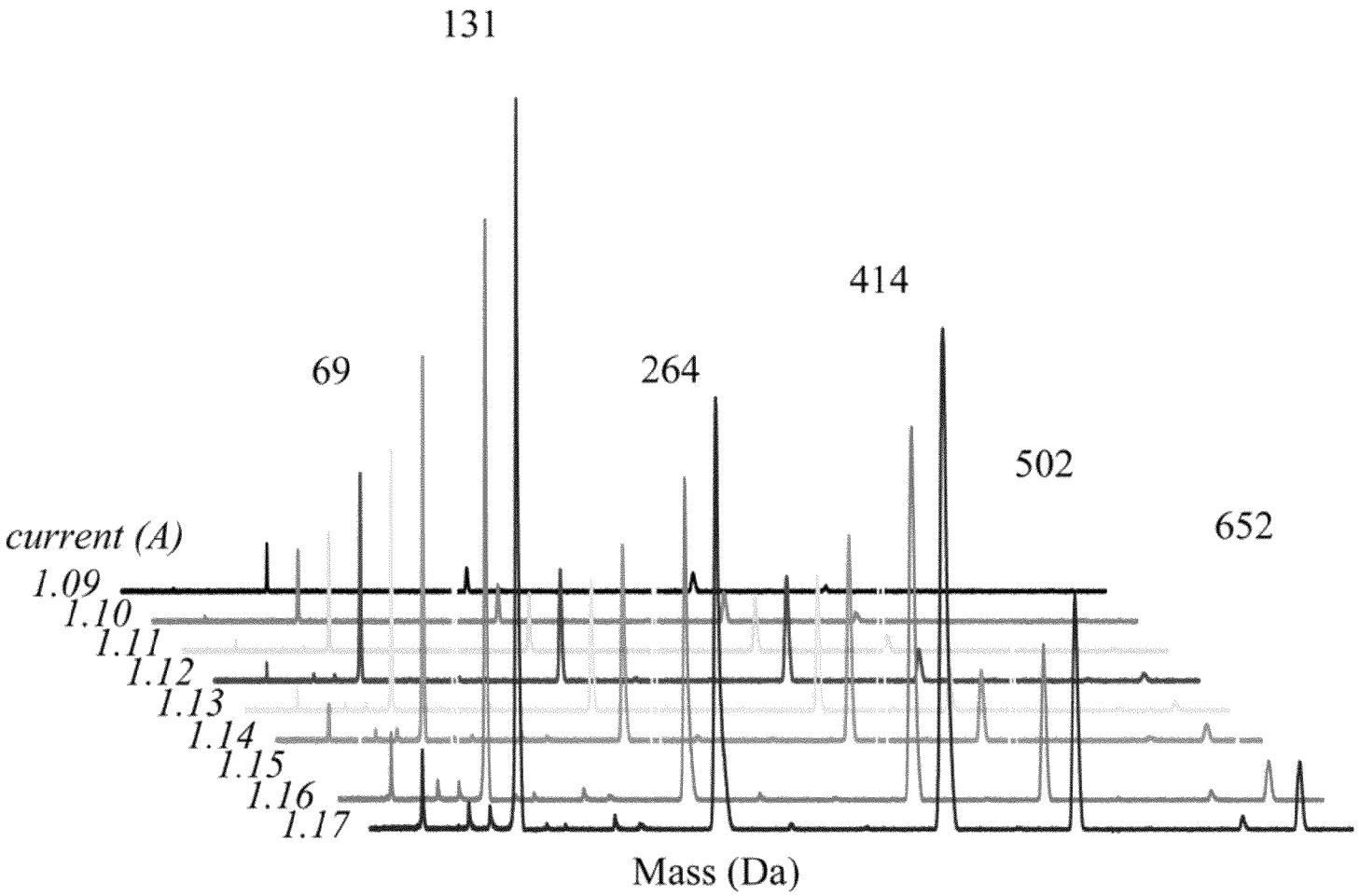
FIG. 8 illustrates plots of 100 sweep-averaged Perfluorotributylamine (PFTBA) mass spectra as measured using different current levels in a system similar to the system illustrated in FIG. 1.
Figure 9:
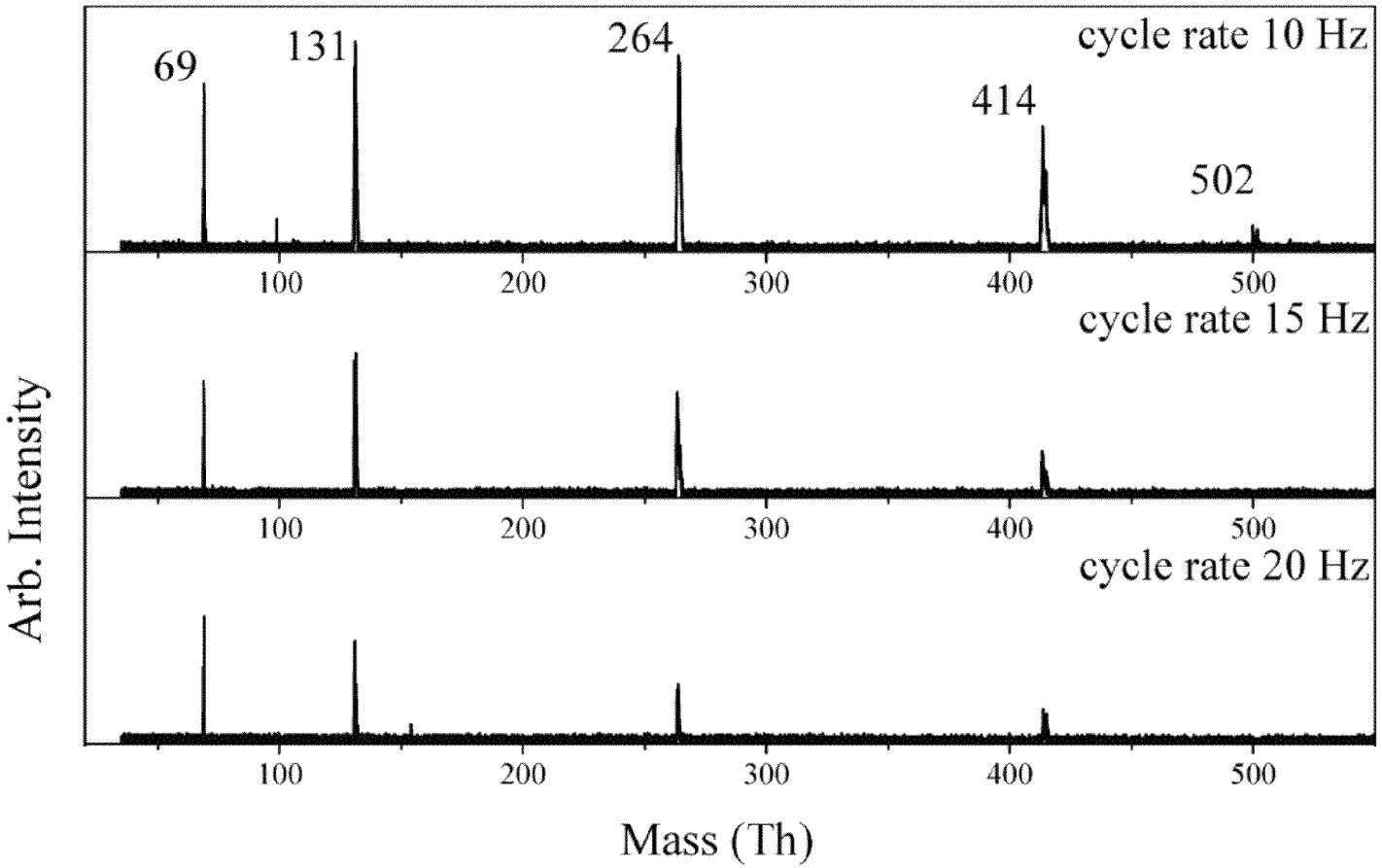
FIG. 9 illustrates plots of the mass spectra of PFTBA as measured with different cycle rates using a system similar to the system illustrated in FIG. 1.
Figure 10:
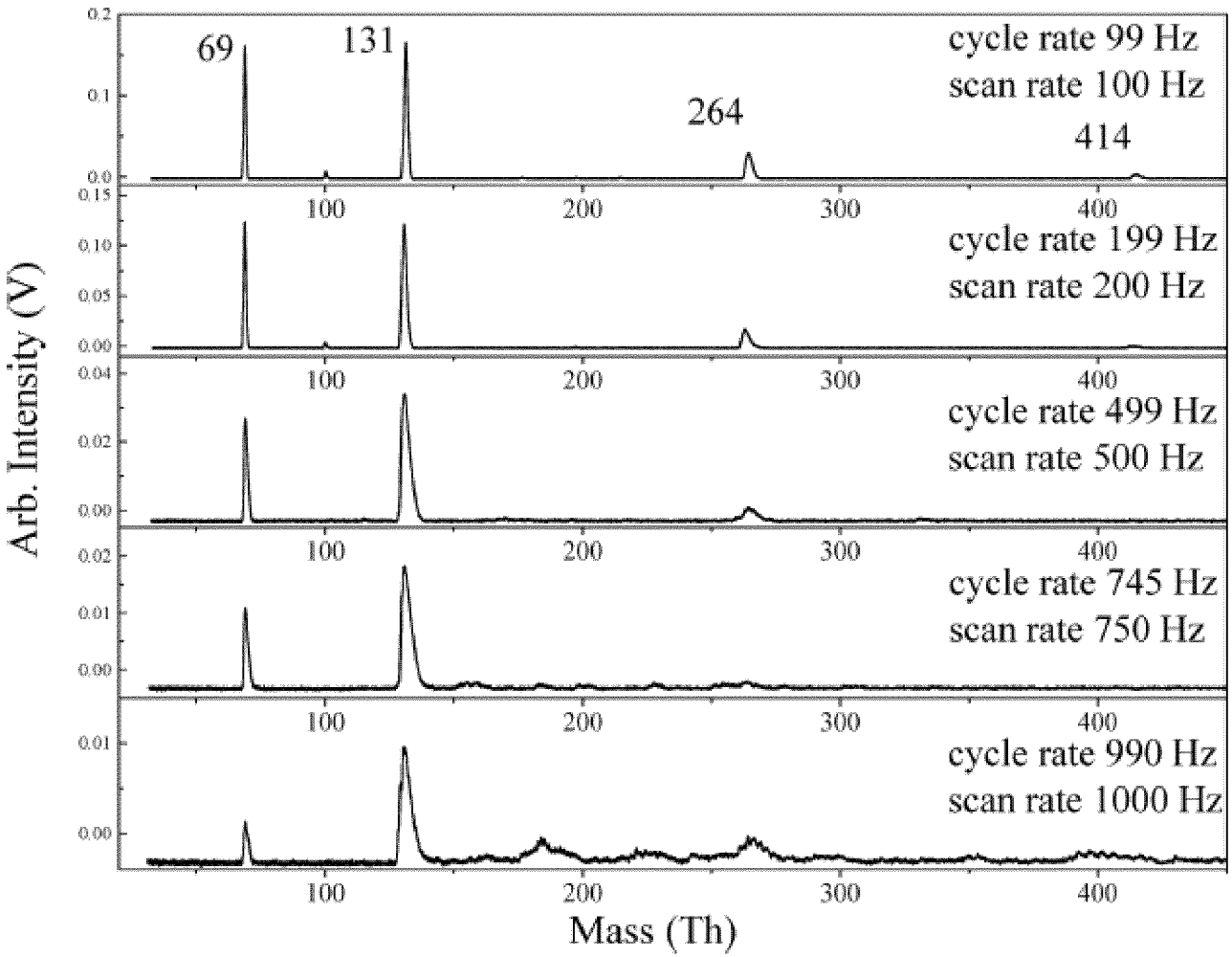
FIG. 10 illustrates plots of the mass spectra of PFTBA as measured with different cycle rates and different scan rates using a system similar to the system illustrated in FIG. 1.

FIGS. 8 to 10 illustrate various experiments employing a mass spectrometer similar to the mass spectrometers described herein. In each experiment, mass spectra were generated by ionizing Perfluorotributylamine (PFTBA). More particularly, PFTBA was introduced into the ion source housing via a precision leak valve to a partial pressure of about $2\times10^{-5}$ Torr. Helium gas was used as a buffer and was leaked into the ion trap to a partial pressure of about $1\times10^{-3}$ Torr. The PFTBA was ionized by applying a current between about 1.00 A and 1.28 A to the filament assembly. During each of the experiments, the end-cap electrodes were grounded and a fundamental waveform was applied to the ring electrode of the ion trap. The ions ejected through the rear end-cap electrode were detected by a Photonis Megaspiraltron. After amplification, the analog signal was captured by a LeCroy model 7200A oscilloscope either in single scans or over an average of several sweeps. Mass calibrations for spectra were based on baseline-subtracted And smoothed spectra, and the mass scale was exponentially fit with standard PFTBA peaks: 69, 131, 264, 414, and 502, according to the NIST chemistry webbook.

FIG. 8 illustrates nine mass spectra plots of 100 sweep-averaged PFTBA mass spectra as generated with various filament currents ranging from 1.09 A to 1.17 A. FIG. 8 illustrates the mass across the x-axis and the y-axis illustrates the mass spectra generated by the different filament currents. The experiments were conducted using a 2 Hz cycle frequency and a 30 Hz scan frequency. The fundamental waveform was swept logarithmically from 950 k Hz to 200 kHz with a voltage level of 400 $V_{peak\text{-}peak}$. FIG. 8 illustrates at each of the current levels tested, the system described herein was able to detect the mass spectra peaks of the NIST standard spectrum for PFTBA.

Also, while signal amplitude increased nonlinearly with the rising current levels, the noise level remained the same. Additionally, the distribution of peaks in the mass spectra was unaffected by changing current levels, maintaining the same relative peak intensity ratios across all ion currents evaluated. The mass spectra showed consistent relative ion ratios across the mass range, indicating that, at this high loading rate and mass scan speed, high-quality spectra are obtained. Peak broadening at high ion currents may be attributed to space charge effects. These could be mitigated by increasing the ion cycle rate, which inherently decreases the absolute number of ions entering the ion trap.

FIG. 9 illustrates four plots of the mass spectra of PFTBA as measured with different cycle frequencies from 10 Hz to 20 Hz. In this set of experiments, the filament current was set to 1.21 A as scans were made as the cycle frequency was set to 10 Hz, 15 Hz, and 20 Hz. For each experiment the scan frequency was 30 Hz. FIG. 8 illustrates that the peak intensity distributions varied as the cycle frequency changed. FIG. 8 also illustrates that at each of the cycle frequencies the system was able to detect the major peaks of the PFTBA spectra.

FIG. 10 illustrates five plots of the mass spectra of PFTBA as measured with different cycle frequencies and different scan frequencies. In this set of experiments the filament current was set to 1.28. The scan frequency was varied from 100 to 1000 Hz. The PFTBA partial pressure was maintained at $2.5\times10^{-5}$ Torr, while the helium buffer gas pressure was increased to $1\times10^{-3}$ Torr to enhance trapping efficiency. Each frequency sweep took place over 99% of the cycle time, and all spectra were averaged over 10 cycles. Peak intensity distributions varied; however, peaks were still clearly detectable at m/z 69, 131, 264, and 414. The 1000 Hz frequency was equivalent to an average mass scan rate of about 400000 Th/s.

What is claimed:

1. A mass spectrometer comprising:

an ion trap configured to continuously receive ions;

an ion source configured to continuously inject the ions to the ion trap;

an ion detector configured to detection ions when the ions are ejected from the ion trap; and a controller configured to cause a repeated frequency-scanned voltage signal to be applied to the ion trap during the continuous injection of the ions into the ion trap, the controller configured to alternate between holding the repeated frequency-scanned voltage signal at a first frequency for a first predetermined amount of time and scanning from the first frequency to a second frequency over a second predetermined amount of time, the scanning of the repeated frequency-scanned voltage signal from the first frequency to the second frequency, causing the ejection of the ions from the ion trap.

2. The mass spectrometer of claim 1, wherein the controller causes the repeated frequency-scanned voltage signal to be applied to a ring electrode of the ion trap.

3. The mass spectrometer of claim 2, wherein a magnitude of the voltage of the repeated frequency-scanned voltage signal is between about 200 V and about 1000 V.

4. The mass spectrometer of claim 2, wherein the first frequency is between about 1.3 MHz and about 700 kHz and the second frequency is between about 350 kHz and about 200 kHz.

5. The mass spectrometer of claim 2, wherein an end-cap electrode of the ion trap is grounded.

6. The mass spectrometer of claim 1, wherein the controller causes the repeated frequency-scanned voltage signal to be applied to an end-cap electrode of the ion trap.

7. The mass spectrometer of claim 6, wherein the controller causes a constant fundamental frequency signal to be applied to a ring electrode of the ion trap.

8. The mass spectrometer of claim 7, wherein the repeated frequency-scanned voltage signal has an initial frequency between about ½ and about ⅛ of the constant fundamental frequency.

9. The mass spectrometer of claim 7, wherein the fundamental frequency is between about 1.3 MHz and about 200 kHz.

10. The mass spectrometer of claim 7, wherein a magnitude of the voltage of the repeated frequency-scanned voltage signal is an order of magnitude less than a magnitude of the voltage of the constant fundamental frequency signal.

11. A method of generating a mass spectra, the method comprising;

providing a mass spectrometer comprising, an ion source configured to continuously inject ions into an ion trap, the ion trap configured to continuously receive ions from the ion source, an ion detector, and a controller configured to apply a repeated frequency-scanned voltage signal to the ion trap;

injecting, in a continuous fashion, ions into the ion trap from the ion source;

applying the repeated frequency-scanned voltage signal to the ion trap during the continuous injection of ions into the ion trap, the repeated frequency-scanned voltage signal alternating between holding a first frequency for a first predetermined amount of time and scanning from the first frequency to a second frequency over a second predetermined amount of time, thereby causing the ejection of the ions from the ion trap; and detecting, by the ion detector, ions ejected from the ion trap.

12. The method of claim 11, further comprising applying the repeated frequency-scanned voltage signal to a ring electrode of the ion trap.

13. The method of claim 11, further comprising scanning the repeated frequency-scanned voltage signal from the first frequency to the second frequency according to a logarithmic progression.

14. The method of claim 11, wherein the first frequency is between about 1.3 MHz and about 700 kHz and the second frequency is between about 350 kHz and about 200 kHz.

15. The method of claim 11, wherein a magnitude of the voltage of the repeated frequency-scanned voltage signal is between about 200 V and about 1000 V.

16. The method of claim 11, further comprising applying the repeated frequency-scanned voltage signal to an end-cap electrode of the ion trap.

17. The method of claim 16, further comprising applying a fundamental frequency voltage signal to a ring electrode of the ion trap.

18. The method of claim 17, further comprising applying the fundamental frequency voltage signal to the ring electrode of the ion trap at a constant frequency.

19. The method of claim 17, wherein the repeated frequency-scanned voltage signal has an initial frequency between about ½ and about ⅛ of the fundamental frequency.

20. The method of claim 17, wherein a magnitude of the voltage of the repeated frequency-scanned voltage signal is an order of magnitude less than a magnitude of the voltage of the fundamental frequency signal.

* * * * *